United States Patent [19]

Beckenbach et al.

[11] Patent Number: 4,767,322

[45] Date of Patent: Aug. 30, 1988

[54] APPARATUS FOR CHARGING A SHAFT FURNACE

[76] Inventors: Ulrich Beckenbach, Fontanestr. 13; Helmuth Beckenbach, An den Linden 47, both of 4005 Meerbusch 1; Werner Hergarten, Bedburger Str. 6, 4000 Düsseldorf, all of Fed. Rep. of Germany

[21] Appl. No.: 122,585

[22] Filed: Nov. 17, 1987

Related U.S. Application Data

[63] Continuation of Ser. No. 898,104, Aug. 20, 1986, abandoned.

[30] Foreign Application Priority Data

Aug. 21, 1985 [DE] Fed. Rep. of Germany ..... 85110485

[51] Int. Cl.[4] ..... F27D 1/08

[52] U.S. Cl. ..... 432/98; 432/99; 432/117; 222/330; 414/162; 414/301

[58] Field of Search ..... 432/239, 95–99, 432/117, 79; 414/162, 172, 193, 195, 300, 301; 222/330, 410

[56] References Cited

U.S. PATENT DOCUMENTS

| | | | |
|---|---|---|---|
| 3,165,304 | 1/1965 | Tvergaard et al. | 432/98 |
| 3,393,905 | 7/1968 | Harris | 432/98 |
| 3,490,619 | 1/1970 | De Wittie | 414/301 |
| 3,591,929 | 7/1971 | Zacpal | 432/117 |
| 3,645,514 | 2/1972 | Lado | 432/79 |
| 4,024,985 | 5/1977 | Iinoya et al. | 222/330 |
| 4,162,960 | 7/1979 | Dhondt | 414/301 |
| 4,497,609 | 2/1985 | Santen | 414/162 |
| 4,564,328 | 1/1986 | Loutaty et al. | 414/301 |

FOREIGN PATENT DOCUMENTS

| | | | |
|---|---|---|---|
| 36033 | 2/1984 | Japan | 414/301 |

*Primary Examiner*—Henry C. Yuen

*Attorney, Agent, or Firm*—Hill, Van Santen, Steadman & Simpson

[57] ABSTRACT

Apparatus for charging a shaft furnace for calcining and sintering material in lump form, such as limestone, dolomite, magnesite or the like, with granular bulk material, with a charging silo arranged above the furnace shaft having a substantially circular cross-section with a substantially homogeneously mixed bulk material and a charging bunker outlet for supplying the bulk material onto the surface of the bulk material column to be covered in the furnace shaft in a distribution controllable over the shaft diameter, characterized by a substantially circular plate arranged in spaced manner below the charging bunker outlet and whose diameter is smaller than the internal diameter of the furnace shaft and larger than the diameter of the opening of the charging bunker outlet and a rotary ring box or the like concentric to the plate and to which is fitted a plurality of strippers which penetrate the sloping bulk material in the plate and with each of the strippers is associated in fixed manner one of the guide chutes or the like terminating at different distances from the median longitudinal axis of the furnace shaft.

3 Claims, 2 Drawing Sheets

APPARATUS FOR CHARGING A SHAFT FURNACE

Figure 1:
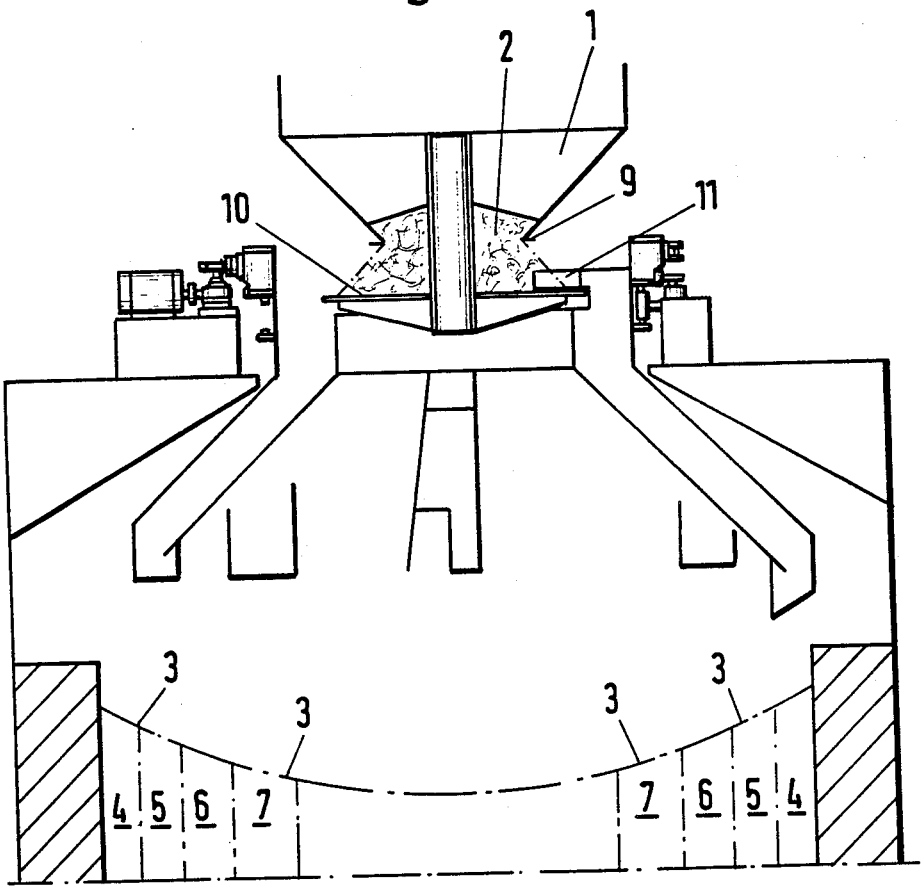

This is a continuation of application Ser. No. 898,104, filed Aug. 20, 1986, abandoned.

The invention relates to an apparatus for charging a shaft furnace for calcining and sintering material in lump form, such as limestone, dolomite, magnesite or the like, with a granular bulk material, with a charging bunker positioned above the furnace shaft having a substantially circular cross-section with a substantially homogeneously mixed bulk material and a charging bunker outlet for feeding the bulk material onto the surface to be covered of the bulk material column located in the furnace shaft with a distribution controllable over the shaft diameter.

The feeding of bulk material in the above-described manner into a shaft furnace for the heat treatment of lump material, such as limestone, dolomite, magnesite or the like, particularly limestone or the like to be calcined, onto the surface of the material column in the furnace shaft and which is to be covered, leads to problems because it is difficult to bring about a uniform distribution of the bulk material already homogeneously mixed in the upper part of the furnace and which is constantly provided from the charging bunker over the furnace over the entire shaft diameter, as a result of the unavoidable slope of the bulk material. Relatively complicated arrangements are known for this purpose, e.g. in the form of charging bells with a different diameter. It is in particular difficult to uniformly cover with sliding bulk material in the desired manner the circular surface of the bulk material or material column in the furnace end to be covered. In such known arrangements, the surface to be covered is subdivided into several circular rings with in each case the same cross-sectional area, i.e. into annular surfaces and a necessarily resulting centrally arranged residual surface with a circular cross-section, to each of which is allocated an identical material quantity.

The problem of the present invention is to provide an apparatus of the aforementioned type making it possible in a simple manner to supply the bulk material to be fed in with a desired distribution over the furnace shaft diameter.

According to the invention, this problem is solved in an apparatus of the aforementioned type by a substantially circular plate arranged in spaced manner below the charging bunker outlet and whose diameter is smaller than the internal diameter of the furnace shaft and larger than the diameter of the charging bunker outlet port, as well as a rotary ring box or the like arranged concentrically to the plate and on which is provided a plurality of strippers projecting into the bulk material sloping on the plate and with each of said strippers is associated a guide chute or the like, whose outlet terminates at a different distance from the median longitudinal axis of the furnace shaft.

According to a particularly preferred embodiment of the invention, the plate is arranged in a preferably horizontally oriented position. The ring box can also be driven in controlled manner by an electric motor or the like.

Another embodiment of the invention is characterized in that the immersion depth of at least one of the strippers into the bulk material located on the plate is adjustable.

The invention optionally proposes that at least one of the guide chutes passes from the plate or ring box in downwardly sloping manner towards the inner wall of the furnace shaft and at least one of the guide chutes runs in the direction of the remaining surface to be covered. According to the invention, the chutes can also terminate in spaced manner above the upper edge of the furnace shaft.

According to another embodiment of the invention, the outlets of the guide chutes are essentially located in a horizontal plane. According to the invention, the strippers can comprise substantially vertically arranged plates, preferably made from sheet metal or the like.

The invention also optionally proposes that the strippers project from a circumferential point of the ring box located behind the particular guide chute in the rotation direction of said box under an angle deviating from the radial direction to a position in the bulk material which is circumferentially located within the area of the particular chute.

Due to the fact that in the apparatus according to the invention, the substantially horizontally arranged circular plate is provided in spaced manner below the charging bunker outlet and whose spacing can be adapted to the particle size of the complete bulk material, in the case of a corresponding plate dimensioning, any undesired bulk material outflow from the charging bunker can be prevented. The strippers uniformly distributed around the circumference of the rotary ring box and which project into the loose material of the bulk material slope on the plate and whose number coincides with the number of the circular rings described hereinbefore, together with the residual surface, during the rotation of the ring box, whose rotation speed is adjustable, take up equal material quantities from the plate and the pocket formed by it and pass the particular bulk material onto the associated guide chute. The guide chutes, like the strippers are fixed to the ring box and rotate therewith. Naturally the number of chutes and strippers is the same, a chute being associated in fixed manner in each case with one stripper. The number of strippers and chutes is the same as the number of circular rings to be covered and the residual surface of the bulk material in the furnace end. As a function of requirements, the number of circular rings can e.g. be four, but can also be more or less. Each chute is constructed in such a way that its outlet passes over its associated circular ring or residual surface of the bulk material in the furnace end.

As a result of the rigid, mechanical connection of the strippers fixed to the rotary ring box to the guide chute, bulk material can only flow over the outer edge of the plate when the rotation of the ring box has started, so that there can be no superimposing or non-movement of the circular rings during starting or stopping. As necessarily all the strippers and the associated chutes deliver material at the same time, all the circular rings and the residual surface are covered at the same time, so that it is not possible for a disadvantage slope to form, as could be the case when only one circular ring was covered. This prevents undesired separation of the bulk material in the furnace. Any correction which may be needed to the individual delivered quantities, such as e.g. for producing a trough-like material surface in the furnace shaft, can be brought about by merely adjusting the immersion depths of the strippers, without it being necessary for an operator to climb into the furnace end.

The invention is described in greater detail hereinafter relative to a non-limitative embodiment and the attached drawings, wherein show:

FIG. 1, an embodiment of an apparatus according to the invention in vertical section through the median longitudinal axis of a furnace shaft.

Figure 2:
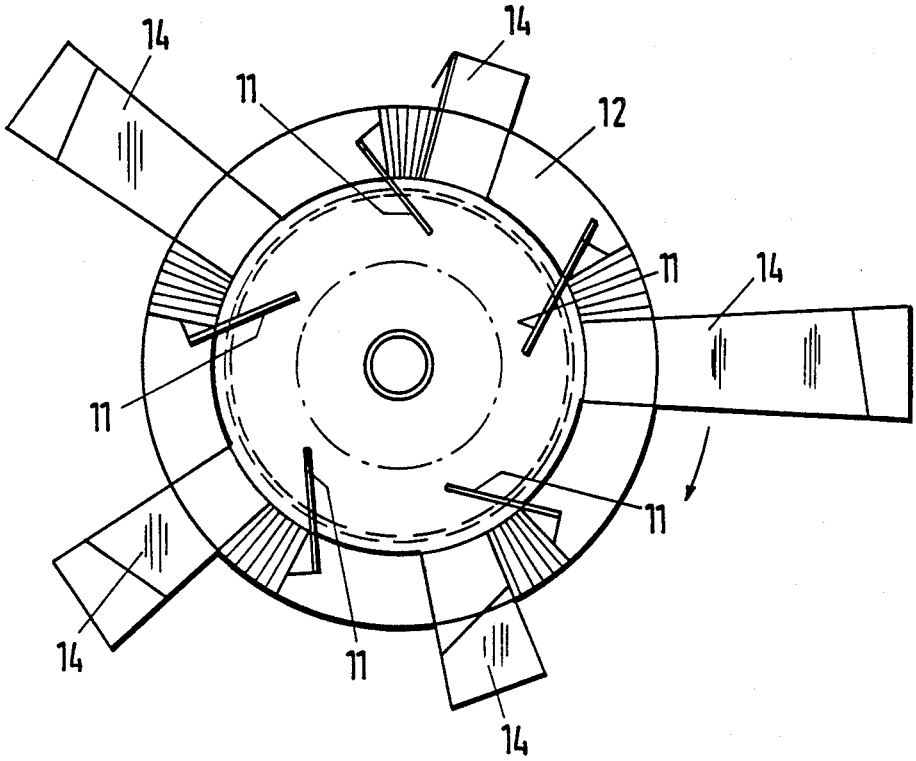

FIG. 2, the embodiment of FIG. 1 in plan view and partly in section.

As can be gathered from the drawings, the already homogeneously mixed bulk material 2 continuously made available by the charging bunker 1 above the shaft furnace is uniformly distributed in the upper part of the furnace on a surface 3 having a circular cross-section. The circular surface 3 of the bulk material in the furnace end to be covered is subdivided into several circular rings 4, 5, 6, 7, with in each case the same cross-sectional area, i.e. into ring areas and a necessarily resulting, centrally located residual area 8 with a circular cross-section, each of the ring areas 4, 5, 6, 7, and the residual area 8 being allocated the same bulk material quantities.

In spaced manner below a charging bunker outlet 9 is provided a circular plate 10. Strippers 11, which project into the sloping bulk material 2 loosely placed on plate 10, are mounted in fixed manner on a rotary ring box 12. The strippers 11 comprise vertically located metal plates which, in the manner shown in FIG. 2, project into the bulk material 2 under an angle differing from the radial direction in such a way that their ends projecting furthest in the direction of the median longitudinal axis of the shaft furnace are located within the circumferential area of the ring box 12 over which the guide chutes 14 associated with each of the strippers 11 slope downwards from the circumferential edge of plate 10. The strippers 11 are uniformly distributed around the circumference of ring box 12, their number coinciding with the number of the circular rings 4, 5, 6, 7, and the residual surface 8. The outlets of guide chutes 14 terminate above the surface 3 to be covered at different distances from the median longitudinal axis of the furnace, one of the chutes 14 in each case running out above each of the circular rings 4, 5, 6, 7, or residual surface 8. Guide chutes 14 are naturally also fixed to the ring box 12, the number of chutes 14 and strippers 11 coinciding.

On rotating the ring box 12, the strippers 11 take up equal material quantities from plate 10 and carry said bulk material onto the associated guide chute 14, which then supplies the material to the particular circular ring 4, 5, 6, 7, or residual surface 8.

The features of the invention disclosed in the description, drawings and claims can be essential to the realization of the different embodiments of the invention, either singly or in random combinations.

We claim:

1. An apparatus for charging a shaft furnace for calcining and sintering material in lump form with granular bulk material, said apparatus having a charging bunker (1) arranged above the furnace shaft which has a substantially circular cross-section, said bunker containing a substantially homogeneously mixed bulk material (2) and said charging bunker having an outlet (9) for supplying the bulk material (2) onto the surface (3) of the bulk material column to be covered in the furnace shaft in a distribution controllable over the shaft diameter, characterized by a substantially circulate plate (10) spaced below the charging bunker outlet (9) in a substantially horizontal position and having a diameter smaller than the internal diameter of the furnace shaft and larger than the diameter of the opening of the charging bunker outlet (9), rotary ring box means (12) concentric to the plate (10), motor means for driving the ring box (12) in a controlled manner and a plurality of strippers (11) fitted thereto which penetrate the bulk material (2) on plate (10) and guide chutes (4) associated with each of the strippers, said chutes terminating at different distances from the median longitudinal axis of the furnace shaft, wherein at least one of the guide chutes (14) slopes downwards in the direction of the inner wall of the furnace shaft from a plate (10) or ring box (12) and at least one of the guide chutes passes in the direction of the surface (3) to be occupied and wherein the guide chutes (14) have terminal end which is spaced above the upper edge of the furnace shaft, wherein the strippers (11) project within the circumference of the ring box at an angle differing from the radial direction.

2. An apparatus according to claim 1, characterized in that the terminal ends of the guide chutes (14) are located substantially in a horizontal plane.

3. An apparatus according to claim 1, characterized in that the strippers (11) include vertically arranged plates.

* * * * *